US008376797B1

(12) United States Patent
Murphy et al.

(10) Patent No.: US 8,376,797 B1
(45) Date of Patent: Feb. 19, 2013

(54) SKI ROPE HANDLE

(76) Inventors: Michael Murphy, Canyon Lake, CA (US); Shawn Stuart Simmon, Canyon Lake, CA (US)

( * ) Notice: Subject to any disclaimer, the term of this patent is extended or adjusted under 35 U.S.C. 154(b) by 149 days.

(21) Appl. No.: 12/987,044

(22) Filed: Jan. 7, 2011

Related U.S. Application Data

(60) Provisional application No. 61/335,453, filed on Jan. 8, 2010.

(51) Int. Cl.
*B63B 35/85* (2006.01)

(52) U.S. Cl. ..... 441/69; 114/253

(58) Field of Classification Search ..... 441/69; 114/253; 16/430, 436, 428
See application file for complete search history.

(56) References Cited

U.S. PATENT DOCUMENTS 3,830,188 A * 8/1974 Humbert ..... 441/69
5,680,677 A * 10/1997 Lovell ..... 441/69
7,959,481 B1 * 6/2011 Wayne ..... 441/69

* cited by examiner

*Primary Examiner* — Lars A Olson
(74) *Attorney, Agent, or Firm* — QuickPatents; Kevin Prince

(57) ABSTRACT

Disclosed is an improved tow rope handle for attaching to a tow line. A bridle has two ends and a central loop for attaching the bridle to the tow line. A forward handle portion has two opposing forward sides and extends rearwardly therefrom to terminate at a central rear side. Each forward side is adapted for fixing with one end of the bridle. A rearward handle portion is fixed at a central forward side thereof with the central rear side of the forward handle portion, preferably with a rotational bearing axially aligned with a longitudinal axis of the forward handle portion. The rearward handle portion further includes two opposing handle grips extending laterally away therefrom. Each handle grip may terminate at a cap that includes a forward projecting stop. As such, a virtual stabilizing triangle is formed between each cap and the central attachment loop, but without bridle ropes that can interfere with or injure the user during use.

13 Claims, 3 Drawing Sheets

SKI ROPE HANDLE

CROSS-REFERENCE TO RELATED APPLICATIONS

This application claims the benefit of U.S. Provisional Patent Application 61/335,453, filed on Jan. 8, 2010, and incorporated herein by reference.

STATEMENT REGARDING FEDERALLY SPONSORED RESEARCH AND DEVELOPMENT

Not Applicable.

FIELD OF THE INVENTION

This invention relates to towed water sports, and more particularly to an improved water sports handle.

DISCUSSION OF RELATED ART

Prior art tow rope handles for water sports such as water skiing typically include a rigid handle fixed at each end to ends of a triangular bridle that is attached at a central forward handle creates a hazardous triangle between each end of the bridle and the rigid handle, through which a user's hands or other appendages may become entangled or snagged, leading possibly to serious injury. Further, such ends of the bridle rope inhibit access to the handle, which leads periodically to a user failing to properly being able to grasp the handle when needed, particularly during ski stunts and the like. During such a ski stunt, the user must be able to grasp the handle through the triangle formed by the ropes and handle, which is more difficult than if the ropes were not present.

Providing a T-shaped handle is one known solution to improving access to the handle. However such a T-shaped handle is unstable when being pulled from its base and tends to twist towards one hand or the other, depending on which hand is holding the handle at any given time. As such, a handle that the user expects to be substantially orthogonal to the longitudinal axis of the tow line may in fact be significantly skewed and difficult to grasp.

Therefore, there is a need for a device that better maintains the gripping portion of the handle in an orthogonal relationship to the axis of the tow line, even when being gripped by only one hand. Further, such a needed device would not obstruct the user's hands from gripping the handle when reaching towards the handle laterally. The present invention accomplishes these objectives.

SUMMARY OF THE INVENTION

The present device is an improved tow rope handle for attaching to a tow line. A bridle has two ends and a central loop for attaching the bridle to the tow line. A forward handle portion has two opposing forward sides and extends rearwardly therefrom to terminate at a central rear side. Each forward side is adapted for fixing with one end of the bridle.

A rearward handle portion is fixed at a central forward side thereof with the central rear side of the forward handle portion, preferably with a rotational bearing axially aligned with a longitudinal axis of the forward handle portion. The rearward handle portion further includes two opposing handle grips extending laterally away therefrom. Each handle grip may terminate at a cap that includes a forward projecting stop.

Preferably each handle grip extends outward from the longitudinal axis of the rearward handle portion a distance greater than the forward sides extend from the longitudinal axis of the forward handle portion, such that a virtual stabilizing triangle is formed between each cap and the central attachment loop, albeit without bridle ropes that can interfere with or injure the user during use.

The present invention is a device that substantially maintains the gripping portion of the handle in an orthogonal relationship to the axis of the tow line, even when the handle grip is being gripped by only one hand. Further, the present device does not obstruct the user's hands from gripping a handle grip when reaching towards the handle grip laterally, unlike the prior art. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
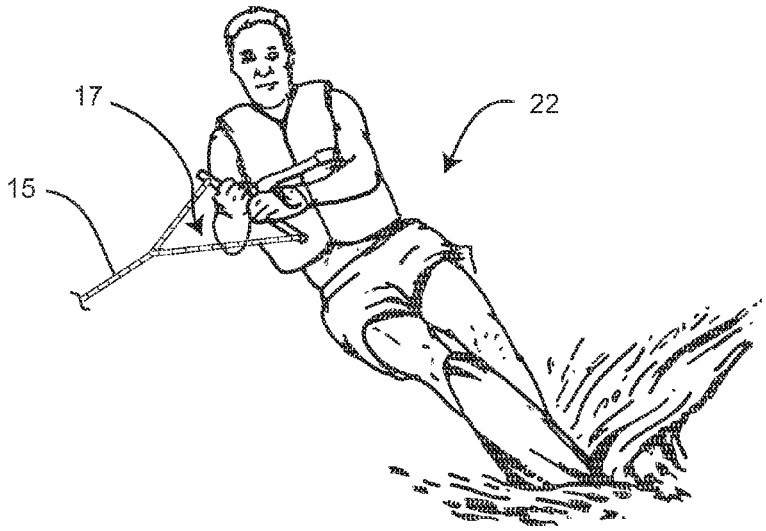
FIG. 1 (PRIOR ART)
FIG. 1 is a perspective view of a prior-art water sports tow handle, illustrating a hazardous triangle in which a user's hands are vulnerably located.

FIG. 1 illustrates a prior art tow rope handle having a rope configuration for attaching to a handle that creates a dangerous triangle 17 into which the hands and other appendages of a user 22 may become entwined and injured.

Figure 2:
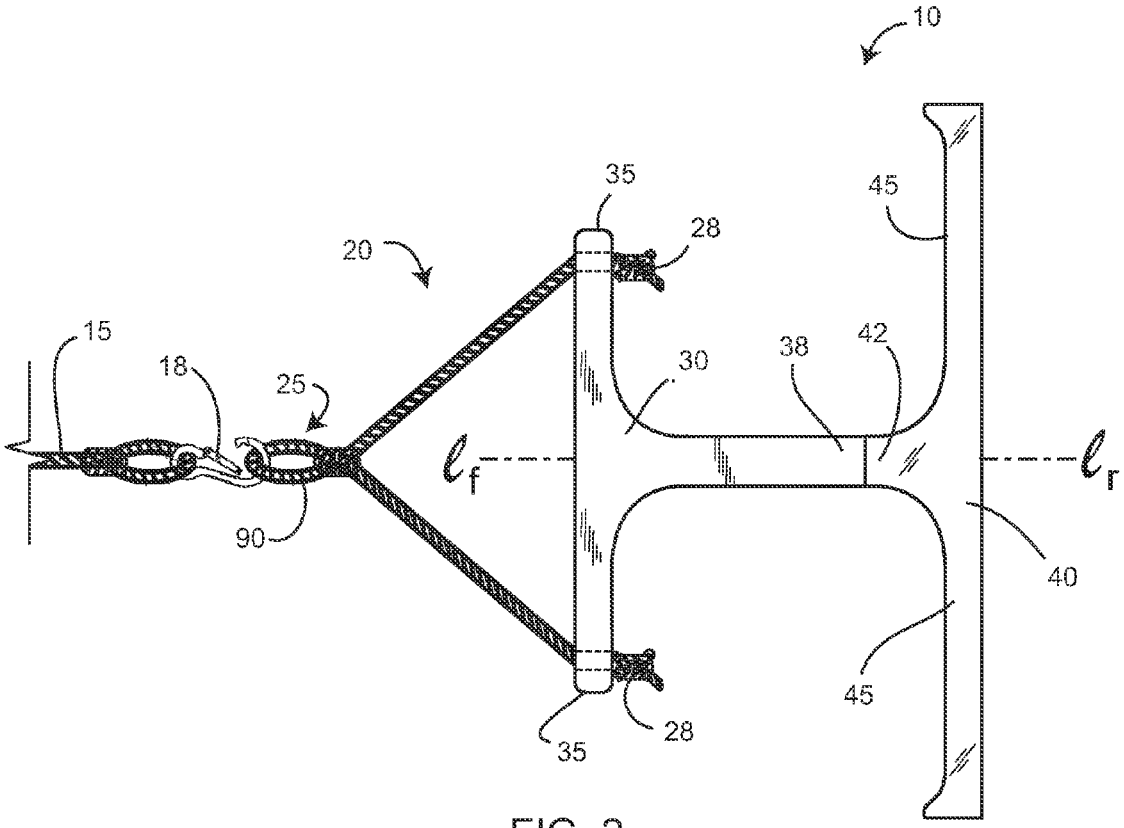
FIG. 2 is a plan view of a tow rope handle of the present invention.
Figure 3:
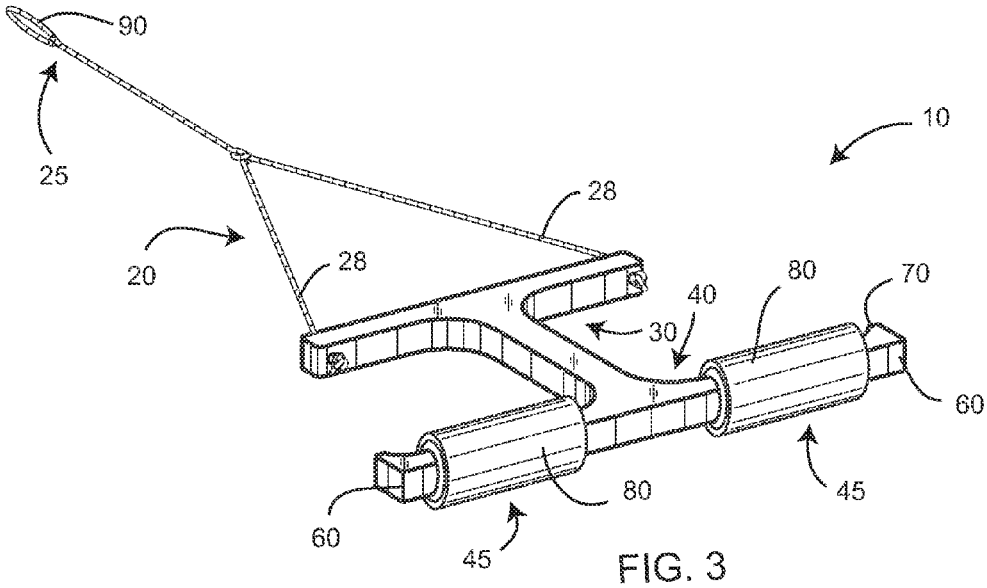
FIG. 3 is a perspective view of the tow rope handle including handle grips.

FIGS. 2 and 3 illustrate an improved tow rope handle 10 for attaching to a tow line 15. A bridle 20 has two ends 28 and a central attachment means 25, such as a central attachment loop 90, for attaching the bridle 20 to the tow line 15 in a conventional manner, such as with a turnbuckle, spring clip 18, or other mechanical fastener.

A forward handle portion 30 has two opposing forward sides 35 and extends rearwardly therefrom to terminate at a central rear side 38. Each forward side 35 is adapted for fixing with one end 25 of the bridle 20, such as with a slot or aperture 39, or other fastening arrangement as is known in the art.

Figure 5:
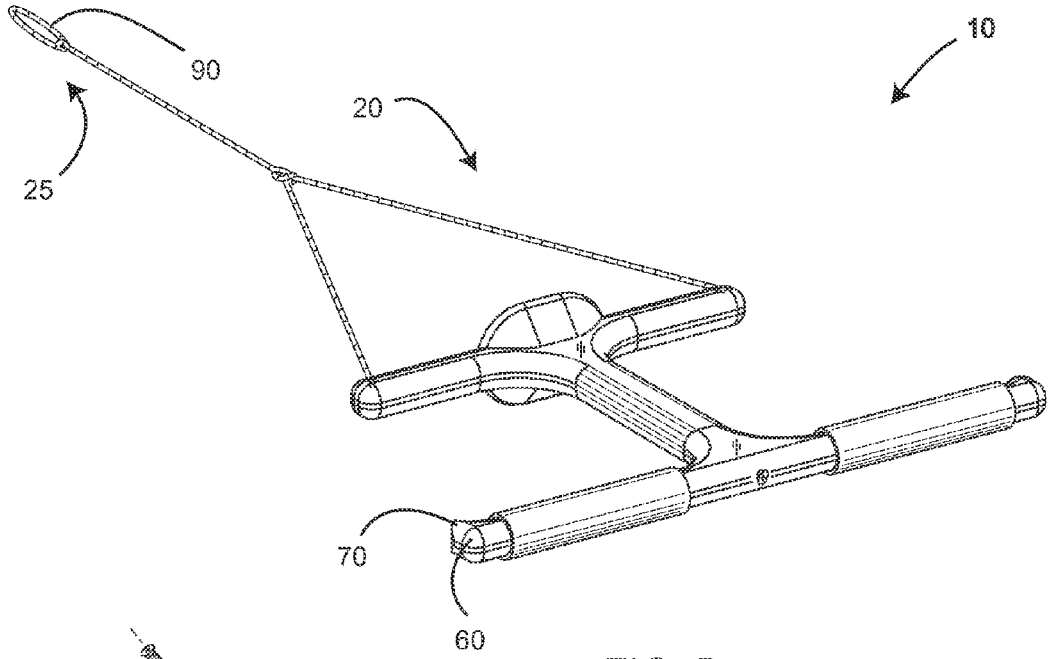
FIG. 5 is a rear perspective view of an alternate embodiment wherein the pivot means includes a rotational bearing.
Figure 6:
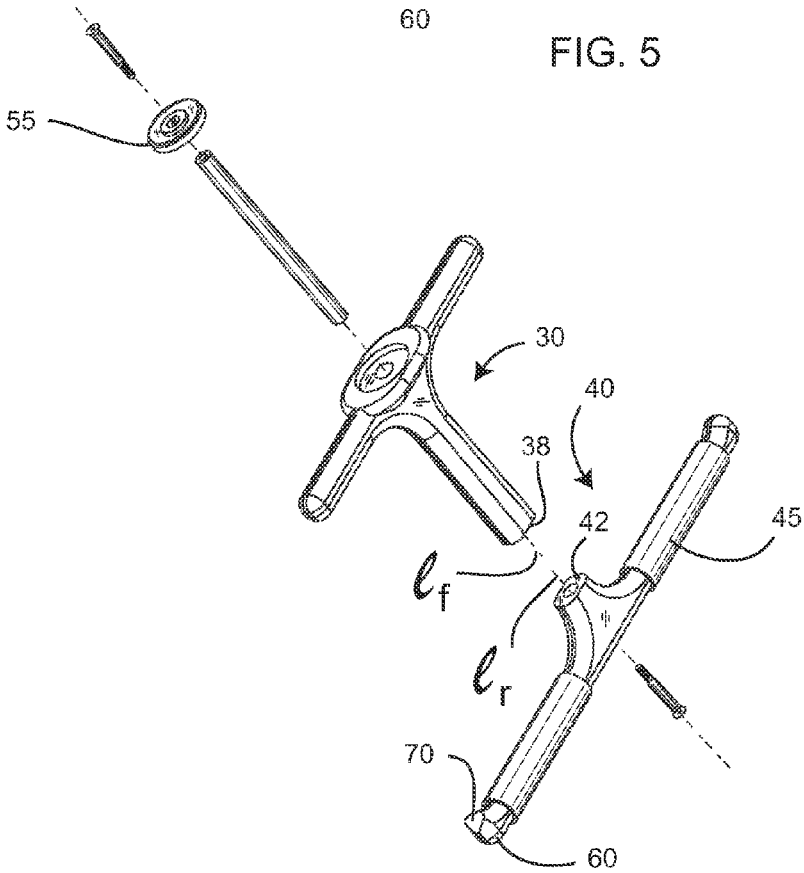
FIG. 6 is an exploded perspective view of FIG. 5.

A rearward handle portion 40 is fixed at a central forward side 42 thereof with the central rear side 38 of the forward handle portion 30, preferably with a pivot means 50 such as a rotational bearing 55 (FIGS. 5 and 6) axially aligned with a longitudinal axis $I_f$ of the forward handle portion 30. In such an embodiment, the rotational bearing 55 sits between the forward handle portion 30 and the rearward handle portion 40. The longitudinal axis $I_f$ of the forward handle portion 30 is substantially co-linear with a longitudinal axis $I_r$ of the rearward handle portion 40 (FIGS. 4 and 6), such that the rearward handle portion 40 may rotate about the longitudinal axis $I_f$ of the forward handle portion 30, which is typically also the longitudinal axis of the tow line 15 when the user 22 is being towed in a straight line, for example.

Figure 4:
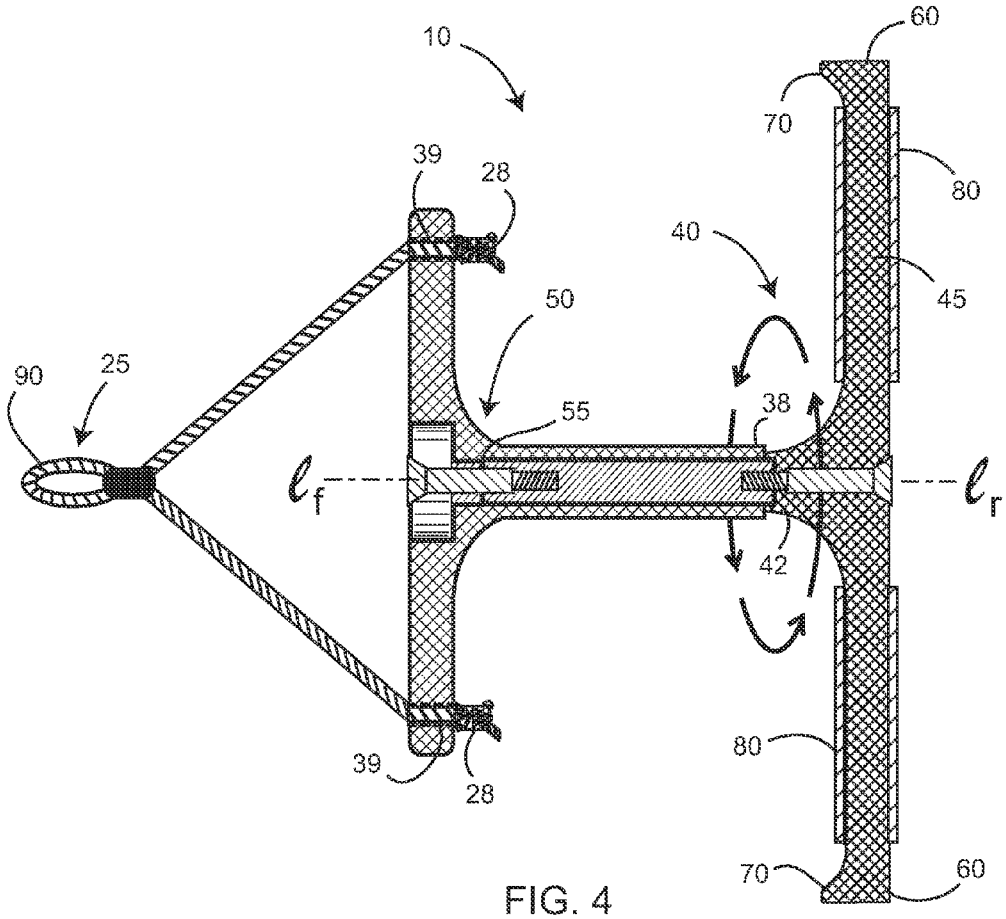
FIG. 4 is a cross-sectional view of a tow rope handle of the invention including a pivot means.

The rearward handle portion 40 further includes two opposing handle grips 45 extending laterally away therefrom. Each handle grip 45 may terminate at a cap 60 that includes a forward projecting stop 70 (FIG. 4). In one embodiment, each cap 60 and forward projecting stop 70 are integrally formed with each handle grip 45 and the rearward handle portion 40. In one embodiment, the handle grip 45 includes a high-friction grip surface 80 (FIG. 4) wrapped or otherwise fixed therearound. Preferably each handle grip 45 extends outward from the longitudinal axis $I_r$ of the rearward handle portion 40 a distance greater than do the forward sides 35 extend from the longitudinal axis $I_f$ of the forward handle portion 30, such that a virtual stabilizing triangle is formed between each cap 60 and the central attachment means 25, albeit without bridle ropes that can interfere with or injure the user 22 during use.

The forward handle portion 30 and rearward handle portion 40 may be each formed with a rigid injection molded plastic material, a semi-rigid elastomeric rubber material, a cast metallic material such as aluminum, or shaped from a wood material.

While a particular form of the invention has been illustrated and described, it will be apparent that various modifications can be made without departing from the spirit and scope of the invention. For example, as illustrated the forward and rearward handle portions 30,40 are T-shaped, but they may also take a triangular or other shape as desired (not shown). Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A tow rope handle for attaching to a tow line, comprising:

a bridle having two ends and a central attachment means for attaching the bridle to the tow line;

a forward handle portion having two opposing forward sides and extending rearwardly therefrom to terminate at only a central rear side, each forward side adapted for fixing with one end of the bridle; and a rearward handle portion fixed at only a central forward side thereof with the central rear side of the forward handle portion, and including two opposing handle grips extending laterally away therefrom, a longitudinal axis of the forward handle portion being substantially co-linear with a longitudinal axis of the rearward handle portion, the laterally extending handle grips free from contact with the tow rope, bridle or forward handle portion.

2. The tow rope handle of claim 1 wherein the central rear side of the forward handle portion is connected with the central forward side of the rearward handle portion at a pivot means axially aligned with a longitudinal axis of the forward handle portion, such that the rearward handle portion may pivot with respect to the forward handle portion about the longitudinal axis thereof.

3. The tow rope handle of claim 2 wherein the pivot means is a rotational bearing fixed between the forward and rearward handle portions.

4. The tow rope handle of claim 1 wherein each handle grip terminates at a cap that includes a forward projecting stop.

5. The tow rope handle of claim 1 wherein each handle grip includes an additional grip surface.

6. The tow rope handle of claim 1 wherein the forward and rearward handle portions are made from a plastic injection molded material.

7. The tow rope handle of claim 1 wherein the forward and rearward handle portions are made from a metallic material.

8. The tow rope handle of claim 1 wherein the forward and rearward handle portions are made from a wood material.

9. The tow rope handle of claim 1 wherein the forward and rearward handle portions are made from an elastomeric material.

10. A tow rope handle for attaching to a tow line, comprising:

a bridle having two ends and a central attachment loop for attaching the bridle to the tow line;

a forward handle portion having two opposing forward sides and extending rearwardly therefrom to terminate at only a central rear side, each forward side adapted for fixing with one end of the bridle; and a rearward handle portion fixed at only a central forward side thereof with the central rear side of the forward handle portion, and including two opposing handle grips extending laterally away therefrom, a longitudinal axis of the forward handle portion being substantially colinear with a longitudinal axis of the rearward handle portion, the laterally extending handle grips free from contact with the tow rope, bridle or forward handle portion.

11. The tow rope handle of claim 10 wherein the central rear side of the forward handle portion is connected with the central forward side of the rearward handle portion at a rotational bearing axially aligned with a longitudinal axis of the forward handle portion, such that the rearward handle portion may pivot with respect to the forward handle portion about the longitudinal axis thereof.

12. The tow rope handle of claim 10 wherein each handle grip terminates at a cap that includes a forward projecting stop.

13. The tow rope handle of claim 10 wherein each handle grip includes an additional grip surface.

* * * * *